US007258506B2

(12) United States Patent
Tipaldo

(10) Patent No.: US 7,258,506 B2
(45) Date of Patent: Aug. 21, 2007

(54) TRIANGULAR RETRACTABLE SAFETY MARKER

(75) Inventor: John M. Tipaldo, 405 B. 132 St., Belle Harbor, NY (US) 11694

(73) Assignee: John M. Tipaldo, Belle Harbor, NY (US)

( * ) Notice: Subject to any disclaimer, the term of this patent is extended or adjusted under 35 U.S.C. 154(b) by 0 days.

(21) Appl. No.: 11/008,620

(22) Filed: Dec. 10, 2004

(65) Prior Publication Data

US 2006/0127175 A1 Jun. 15, 2006

(51) Int. Cl.
*G09F 13/16* (2006.01)
*E01F 9/00* (2006.01)
*E01F 9/015* (2006.01)

(52) U.S. Cl. ..... 404/9; 116/63 T; 116/63 P

(58) Field of Classification Search ..... 404/6, 404/9; 116/63 P, 63 R, 63 T; 340/908.1
See application file for complete search history.

(56) References Cited

U.S. PATENT DOCUMENTS 3,625,177 A * 12/1971 Miller ..... 116/63 P
3,798,814 A * 3/1974 Harmon ..... 40/590
4,489,306 A * 12/1984 Scolari ..... 340/473
4,825,191 A * 4/1989 Ching-Hwei ..... 340/472
5,613,798 A * 3/1997 Braverman ..... 404/6
5,775,253 A * 7/1998 Quan et al. ..... 116/63 T
6,508,195 B1 * 1/2003 Tipaldo ..... 116/63 P
6,535,113 B1 * 3/2003 Gravolin ..... 340/431
2002/0062780 A1 * 5/2002 Chen ..... 116/63 P

* cited by examiner

*Primary Examiner*—Raymond Addie

(57) ABSTRACT

A triangular retractable safety marker provides motorists and motorcyclists with advance warning of disabled vehicles and/or work zone areas. The device has been designed to withstand reasonable winds through the use of two base supports, a lower portion and two sets of lower, middle and upper risers. The risers allow for the device to easily expand to height consistent with traffic engineering design standards for triangles when in operation and then compact when it is in storage. The two base supports in are designed not only to provide the necessary structural stability but to also open and close about the retractable risers thus providing for additional compactness. The upper part of the lower portion along with the two sets of lower, middle and upper risers have reflective decals affixed to them to correspond with standard triangle design.

6 Claims, 5 Drawing Sheets

TRIANGULAR RETRACTABLE SAFETY MARKER

BACKGROUND AND SUMMARY OF THE INVENTION

This application relates to means of alerting motorists to the presence of disabled vehicles or work zone areas. Each year hundreds of motorists are either killed or injured along side the roadway. Many of these accidents may be prevented if the oncoming motorist had advance warning of the presence of these disabled vehicles. In addition the Federal Motor Carrier Safety Association requires that all trucks and buses with a gross weight rating (GVWR) of over 10,000 pounds carry triangular warning devices. The present invention incorporations elements disclosed in my prior U.S. Pat. No. 6,508,195.

In recent years, a variety of traffic warning devices have become known and reference may be had to the following U.S. patents for a description of these prior art of traffic warning devices; U.S. Pat. Nos. Des. 6,508,195, 4,531,472, 5,263,272, 5,502,909, 5,544,614, 5,775,833, 5,517,395, 5,755,253, 4,535,331.

The present invention is a significant improvement over present triangles in that it requires approximately ⅓ the storage space when compared to existing designs. This is significant in increasing the attractiveness of the triangles to uses with limited storage space. A primary benefactor of such a design would be motorcyclist's who could easily store the compacted device in their side compartment of saddle bag. Currently the standard design is too big to fit into these storage devices. Another advantage would be the contracted design would be able to fit in a car's the glove compartment.

Therefore the presented invention is designed to help eliminate shortfalls with the current devices. It is envisioned that by increasing the attractiveness, more people will carry the devices in their vehicles and a decrease in roadside fatalities and injuries would result.

The Triangular Retractable Safety Marker has been designed to be employ easily, store compactly, withstand prevailing winds and be economical.

The Triangular Retractable Safety Marker is a combination of several pieces. The first two pieces are referenced to as the base supports. The base supports of the present invention are similar is design and function to the base supports disclosed in my prior U.S. Pat. No. 6,508,195. Another piece is referred to as the lower portion. The lower portion contains several strategically placed holes that allow for the base supports and lower risers to be permanently affixed to it. There are two lower risers, two middle risers and two upper risers. The lower riser is a one sided slotted angular element. The middle riser is also slotted and designed to fit inside the slot on the lower riser. The upper riser is a flat piece and is designed to fit into the slot on the middle riser. There are also two pivot pins that allow for the permanent connection between the lower risers and the lower portion.

The two base supports are intended to provide the necessary weight to ensure that the device is not displaced under reasonable wind loads. Each base support also has two strategically placed tabs. The base support is primarily a rectangular type box with the top end and one of the sides open. The long sides of the base support contain a tab at the "open" end of the box. These tabs are designed to allow the base support to be affixed to a slot in the lowest vertical riser.

The Triangular Retractable Safety Marker has been designed for easy placement during emergency situations. The first step in the application process is to rotate the two base supports from the closed to the open position (parallel with the lower portion). Then the lower portions are rotated to a position parallel to the ground. Then the middle and upper risers are extended to a locked position. The two uppers risers are snapped together. At this point the invention is ready for application.

BRIEF DESCRIPTION OF THE DRAWINGS

The subject matter which is regarded as the present invention is particularly pointed out and distinctly claimed in the concluding portion of the specification. The invention, however, both as to organization and method of practice, may be best understood by reference to the detailed description, taken in conjunction with the accompanying drawings, in which:

DETAILED DESCRIPTION

Reference will now be made to the drawings in which the various elements of the present invention will be given numerical designations. In its present form the invention consists of several distinct elements. These elements when combined as described within will allow one of ordinary skill in the art to made and use the present invention.

Figure 1:
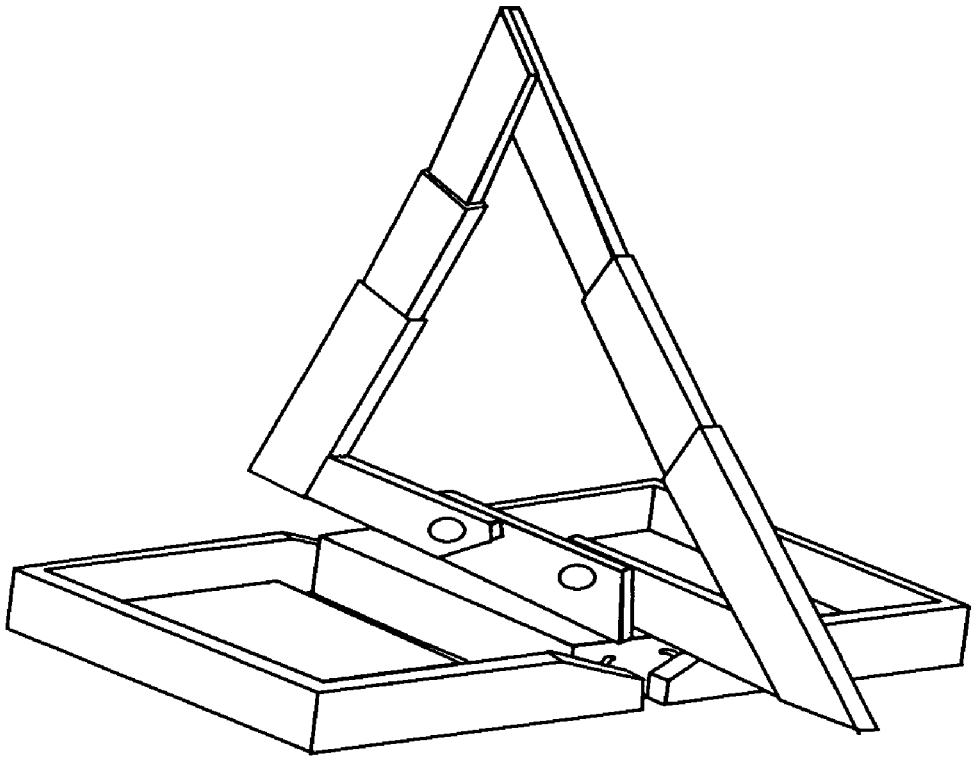
FIG. 1—Is a perspective view of the current invention in the "expanded" and "open" position.
Figure 2:
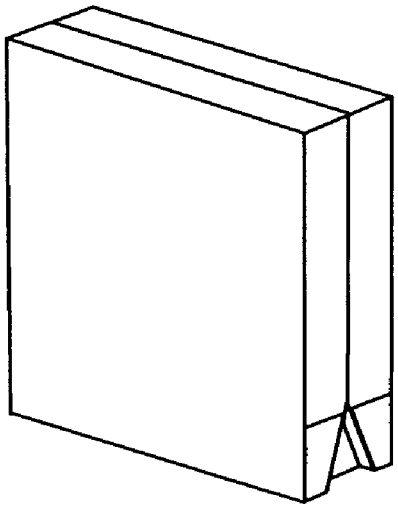
FIG. 2—Is a perspective view of the current invention the "contracted" and "closed" position.
Figure 3:
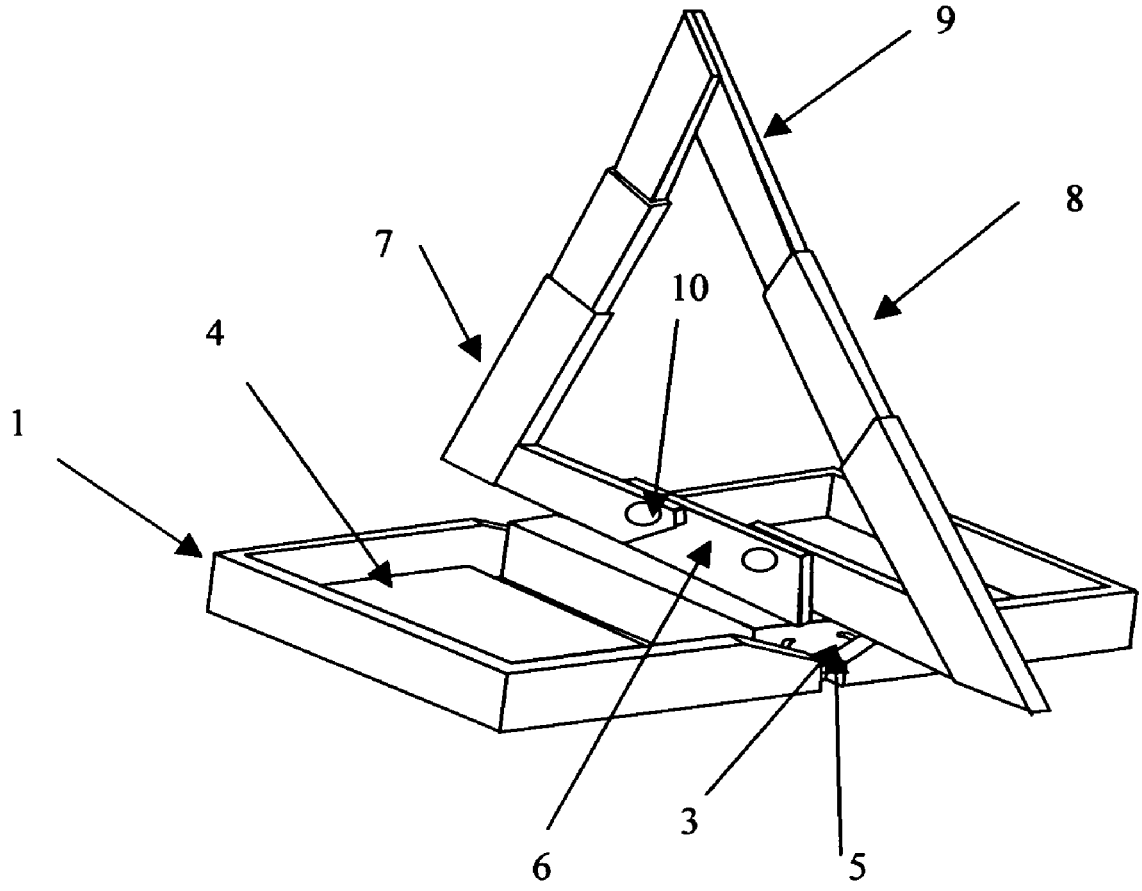
FIG. 3—Is a perspective view of the current invention with in the "expanded" and "open" position illustrating reference numerals.
Figure 6:
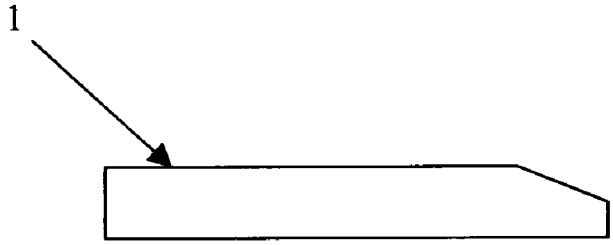
FIG. 6—is a side view of the base support.
Figure 7:
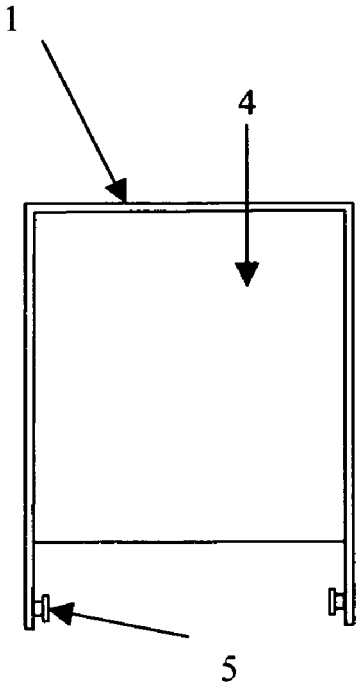
FIG. 7—is a top view of the base support.
Figure 8:
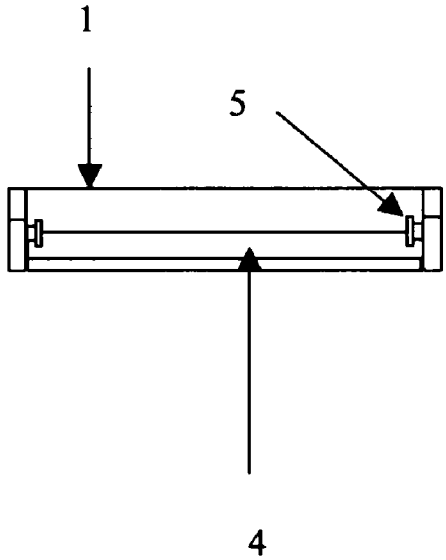
FIG. 8—is a plan view of the base support.

Referring to FIG. 3, the current invention is compromised of two base supports (1) that are attached to the lower portion (6), by means of tabs (5) on the base supports (1) and holes (5) in the lower portion (6) that are designed to keep the base supports (1) permanently affixed to the lower portion (6). FIG. 2 illustrates the current invention in the "closed" and "contracted" position. Contain within the base supports (1) are rectangular or circular support weights (4). These support weights (4) are designed to help the total structure resist displacement under high wind conditions. The base supports are illustrated in FIGS. 6, 7 and 8. As illustrated in FIGS. 7 and 8, the base support (1) contains tabs (5). These tabs (5) are used to secure the base support (1) to the lower portion (6).

Figure 4:
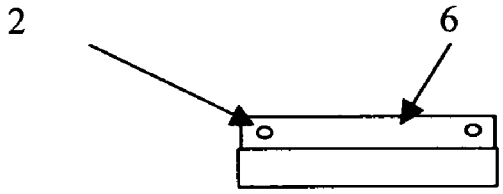
FIG. 4—Is a plan view of the lower portion.
Figure 5:
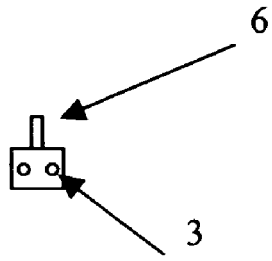
FIG. 5—is a side view of the lower portion.

FIGS. 4 and 5 illustrate the lower portion (6). As illustrated the lower portion (6) has a series of holes (2) on its top portion and a series of holes (3) on its side. The purpose of holes (2) on the top portion is to allow the lower riser (7) to be permanently attached to the lower portion (6) and act as a pivot point when a pivot pin (10) in inserted.

Figure 9:
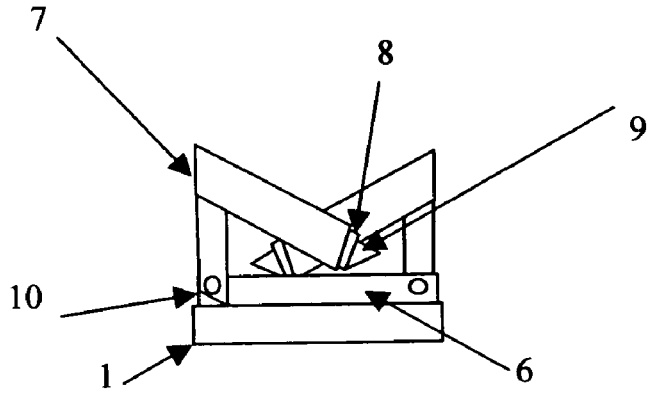
FIG. 9—is a plan view of the current invention in the "contracted" and "open" position.
Figure 10:
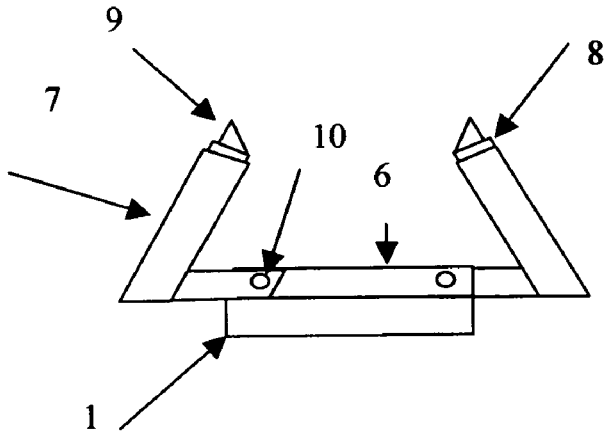
FIG. 10—is a plan view of the current invention in the "partially retracted" and "open" position.
Figure 11:
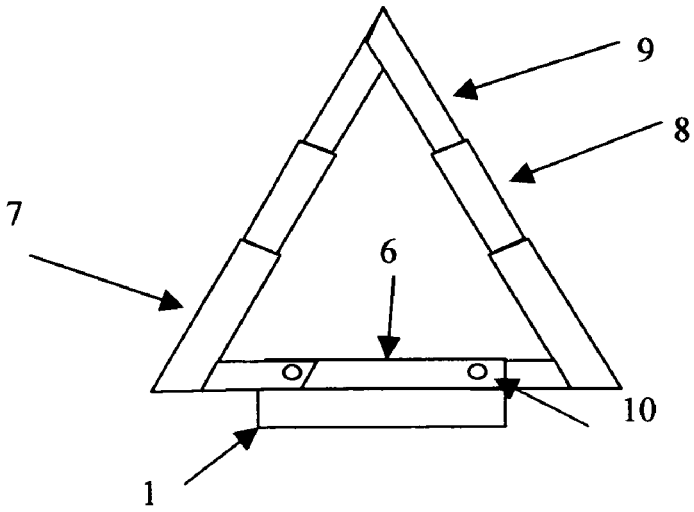
FIG. 11—is a plan view of the current invention in the "expanded" and "open" position.
Figure 12:
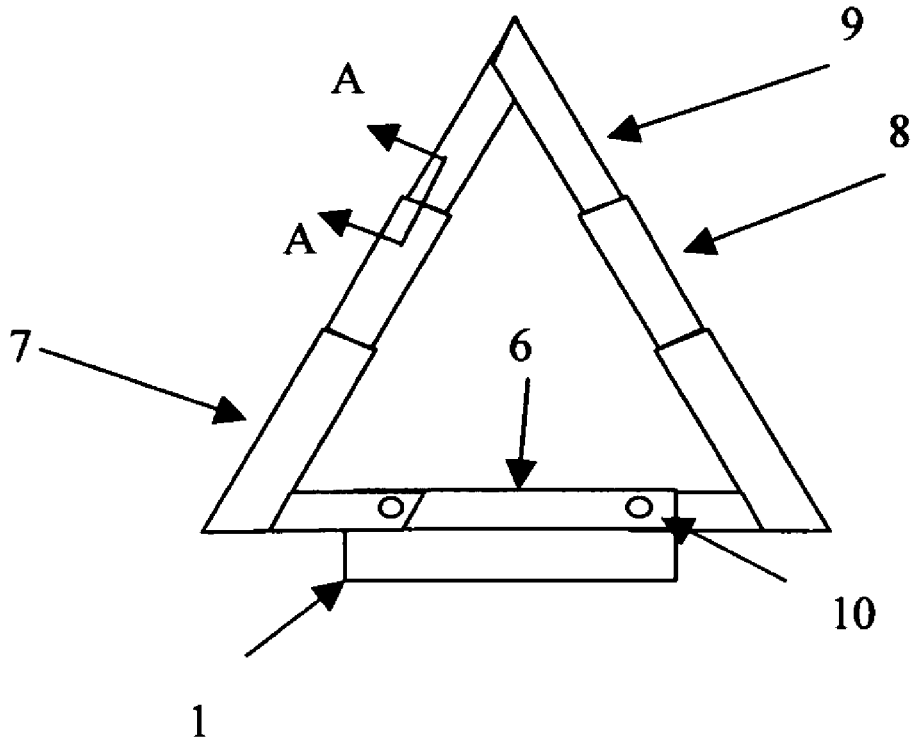
FIG. 12—is a plan view of the current invention is illustrating cross-sectional line A-A.

Illustrated in FIGS. 9, 10 and 11 are a series of vertical risers (7,8 and 9). The lower riser (7) is angular shaped with an open slot that allows for middle rise (8) to be inserted within. The middle riser (8) also is slotted to allow the upper riser (9) to be inserted within.

The lower riser (7) pivots via the pivot pin (10) around the hole (2) in the lower portion (6). When the lower riser (7) is parallel to the base support (1), the middle and upper risers (8,9) are fully extended. When combined with similar set-up on the opposite side of the lower portion (6) a triangular shape is created. This is illustrated in FIG. 11.

Figure 13:
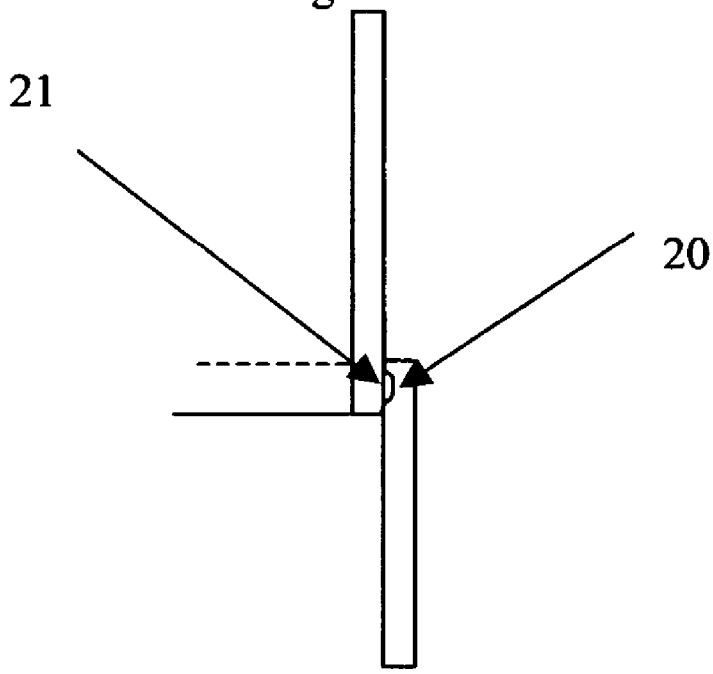
FIG. 13—is a cross-sectional view of the "bulb" and "notch" method used to secure the risers.

The lower, middle and upper risers (7,8,9) are secured in place when fully extended by either friction or by a series of "notches" (20) and "bulbs" (21) on each vertical riser. This "notch" and "bulb" connection is illustrated in FIG. 13.

To deploy the current invention, the user simply rotates the two base supports into a locked position perpendicular to the lower portion then rotates the lower riser from a perpendicular to parallel position in relation to the open base support and the lifts the series of middle and upper risers into a locked position.

What is claimed:

1. A triangular retractable safety marker, comprising:

a horizontally positioned rectangular base member;

a first vee shaped corner member having a first arm and a second arm, said first arm rotatably attached to a left portion of said rectangular base member;

a first middle riser slidably attached to said second arm of said first vee shaped corner member to extend said second arm of said first vee shaped corner member in a first direction;

a first upper riser slidably attached to said first middle riser to extend said first middle riser in said first direction;

a second vee shaped corner member having a first arm and a second arm, said first arm rotatably attached to a right portion of said rectangular base member;

a second middle riser slidably attached to said second arm of said second vee shaped corner member to extend said second arm of said second vee shaped corner member in a second direction;

a second upper riser slidably attached to said second middle riser to extend said second middle riser in said second direction;

wherein an equilateral triangle is formed when said first vee shaped corner member and said second vee shaped corner member are rotated outward, said first middle riser and said first upper riser are extended in said first direction, and said second middle riser and said second upper riser are extended in said second direction.

2. The triangular retractable safety marker of claim 1, further comprising means to support said triangular retractable safety marker in a vertical position.

3. The triangular retractable safety marker of claim 1, further comprising:

a base attached to a bottom of said rectangular base member;

a first base support foldable at a first position about said base;

a second base support foldable at a second position about said base;

wherein when said first vee shaped corner member and said second vee shaped corner member are rotated inward, said first middle riser and said first upper riser are retracted in a directed opposite to said first direction, and said second middle riser and said second upper riser are retracted in a direction opposite to said second direction, said first and second base supports fold closed to encase said triangular retractable safety marker, and wherein a when said first vee shaped corner member and said second vee shaped corner member are rotated outward, said first middle riser and said first upper riser are extended in said first direction, and said second middle riser and said second upper riser are extended in said second direction, said first and second base supports fold open to form a horizontal base for said equilateral triangle.

4. The triangular retractable safety marker of claim 3, wherein said first and second base supports in the folded open positions are weighted to support said equilateral triangle.

5. A triangular retractable safety marker, comprising:

two base supports movable about a central portion between opened and closed positions;

a first vee shaped corner member having a first arm and a second arm, said first arm rotatably attached to a left portion of said central portion;

a first middle riser slidably attached to said second arm of said first vee shaped corner member to extend from said second arm of said first vee shaped corner member in a first direction;

a first upper riser slidably attached to said first middle riser to extend from said first middle riser in said first direction;

a second vee shaped corner member having a first arm and a second arm, said first arm rotatably attached to a right portion of said central portion;

a second middle riser slidably attached to said second arm of said second vee shaped corner member to extend from said second arm of said second vee shaped corner member in a second direction;

a second upper riser slidably attached to said second middle riser to extend from said second middle riser in said second direction;

wherein a retractable triangle is formed when said first vee shaped corner member and said second vee shaped corner member are rotated outward, said first middle riser and said first upper riser are extended in said first direction, and said second middle riser and said second upper riser are extended in said second direction.

6. The triangular retractable safety marker of claim 5, further comprising means to support said triangular retractable safety marker in a vertical position.

* * * * *